United States Patent [19]

Sullivan et al.

[11] 4,347,874

[45] Sep. 7, 1982

[54] HIGH SPEED STERILE FLUID TRANSFER UNIT

[76] Inventors: James J. Sullivan, 1329 N. Foothill Rd., Ojai, Calif. 93023; Charles M. Grey, 1518 Conestoga Ct., Redlands, Calif. 92373

[21] Appl. No.: 193,364

[22] Filed: Oct. 2, 1980

[51] Int. Cl.[3] ..... B65B 3/12

[52] U.S. Cl. ..... 141/1; 128/214 R; 128/214.2; 141/231; 141/329; 141/382

[58] Field of Search ..... 128/214 R, 214 F, 214.2, 128/DIG. 12; 141/1, 231, 329, 330, 382, 383, 392; 417/474, 478

[56] References Cited

U.S. PATENT DOCUMENTS 4,184,815 1/1980 Casson et al. ..... 128/214 F X 4,243,031 1/1981 Genese ..... 128/214 F X

*Primary Examiner*—Frederick R. Schmidt

*Attorney, Agent, or Firm*—Poms, Smith, Lande & Rose

[57] ABSTRACT

A sterile fluid transfer unit for intravenous fluids includes a large diameter silicone rubber tubing for use with a peristaltic type roller pump firmly pre-connected between two pieces of one-eighth diameter tubing, for connection respectively to a manufacturer's "Piggy-Back" bottle, and to a large container of diluent. The connections between the silicone rubber tubing and the smaller diameter plastic tubing are accomplished by the use of custom fitted spike-type plastic fittings which penetrate the silicone rubber tubing and which are cemented to the plastic tubing, and avoid any possibility of the seals being broken and liquid being spilled. One of the two smaller diameter plastic tubes has a shut-off clamp and a large vented spike connection for coupling to the large container supplying the diluent, and the other plastic tubing is provided with a threaded Luer type connection for receiving a small vented spike for filling of I.V.P.B.'s (manufacturers' piggyback vials) or an adaptor connection for filling a syringe.

12 Claims, 3 Drawing Figures

HIGH SPEED STERILE FLUID TRANSFER UNIT

FIELD OF THE INVENTION

This invention relates to a fluid transfer assembly for intravenous (I.V.) fluids, for use with peristaltic type roller pumps.

BACKGROUND OF THE INVENTION

So-called peristaltic pumps involve the use of a roller applying pressure along the length of a flexible tube and forcing the liquid through the tubing. Because the peristaltic pump removes all of the liquid from the section of flexible tube which is being engaged by the moving roller, such pumps are well suited for pumping measured amounts of liquid in a sterile environment. Up until recently, these pumps had been used principally for filling Petri dishes with agar, by way of specific example. The size of the flexible tubing which is provided for use with commercial peristaltic pumps is characteristically in the order of one-quarter inch outer diameter, and the tubes are approximately two feet in length, although the part of the tube which is actively engaged by the pressure roller is less than one foot in length.

When it is desired to use a peristaltic pump for transfer of intravenous (IV) liquids, with the greatly increased requirement for absolute sterility, it has been the practice to use a sterile package of the two-foot long, one-quarter inch outer diameter silicone rubber tubing, and an available secondary transfer set, and to assemble them by hand. The secondary transfer set includes a fitting for securing to one end of the silicone rubber tubing, a roller valve on the small diameter plastic tubing, and a large vented spike for attaching to a large container of diluent. A vented needle is secured to the other end of the silicone rubber tubing for supplying the pumped intravenous liquid to a manufacturer's "Piggy-Back" vials or bottles (often referred to as "I.V.P.B.'s") containing powder to be reconstituted.

The rubber tubing for use in the peristaltic pump and the secondary transfer set should be assembled in sterile laminar flow hood conditions, but this procedure is time-consuming and often dispensed with, at the risk of touch contamination where the parts are joined. In addition, the female connector end of the silicone rubber tubing can split if undue pressure is applied, leaving a space for leakage of the fluids being transferred and for possible contamination. Also, when the quarter-inch diameter silicone rubber tube extends to the outlet of the system, there is some tendency for liquid to flow, even after shut-off of the valve. One type of diluent which is frequently used is a five percent dextrose solution, and such solutions constitute an ideal breeding point for bacteria. The slow rate of transfer of fluid is also inconvenient, as the prior transfer units required approximately 18 seconds for filling each standard size 100 milliliter bottle, with 50 cc of diluent, and a large number of bottles must often be filled. Further, when attempts have been made to increase the flow rate by doubling the number of rollers engaging the tube, it was found that the peristaltic motors would burn out in view of the additional load.

Accordingly, a principal object of the present invention is to provide a simple unitary fluid transfer unit for peristaltic pumps which avoids the problems of slow speed and lack of sterility which have been present in the makeshift arrangements previously utilized.

SUMMARY OF THE INVENTION

In accordance with a specific illustrative embodiment of the present invention, a sterile IV fluid transfer unit includes in a single sterile package, a short section of large diameter silicone rubber tubing custom fitted through plastic fittings to two sections of relatively small diameter plastic tubing (outer diameter approximately one-eighth inch), with a large vented spike for securing to a supply of diluent at the other end of one of the plastic tubes, a shutoff valve on the upper length of plastic tubing, and with a Luer type threaded fitting at the far end of the second section of plastic tubing. This second Luer type fitting is adapted to receive either a two-way vented needle for use in filling manufacturer's "piggy-back" bottles or special adapter fittings for filling syringes. The two plastic tubes are of sufficient length, such as one and one-half or preferably two feet long, for ease in making connection to the source and receptacle containers.

The silicone rubber tubing may be relatively short, in the order of one foot in length, for use with commercially available peristaltic pumps, and the fittings are such as to provide substantial overlapping area for custom fitting the ends of the rubber tubing, and for the cementing of the plastic tubing to the fitting. The relatively large diameter rubber tubing which is employed may be approximately 0.330 inch outer diameter and approximately 0.180 inch inner diameter. The outer diameter of the plastic spikes interconnecting with the silicone rubber tubing is substantially greater than the 0.180 inner diameter of the silicone rubber tubing to form a tight custom fitted connection with substantial overlap to positively proclude leakage. This is in contrast to the approximate 0.25 inch outer diameter tubing which is normally used.

Advantages of the new unit include great savings in time, both in the speed of transfer which is reduced from about 18 seconds to about 6 seconds, and in avoiding the need for sterile assembly of the parts needed to make up a transfer unit within a laminar flow sterile hood in accordance with prior practice. An additional advantage is the substantial elimination of several sources of possible contamination, from the spilling of liquids and from touch contamination. With a section of small diameter plastic tubing located between the large diameter silicone rubber tube and the output from the unit, little or no loss of fluid occurs upon shutoff. The preformed joints between the plastic tubes and the rubber tube eliminates one more source of possible contamination which could occur if the joint between the two subassemblies as used heretofore were subject to either too much or too little pressure in securing them together, resulting in breakage or leakage.

Other objects, features and advantages will become apparent from a consideration of the following detailed description and from the accompanying drawings.

DETAILED DESCRIPTION

Figure 1:
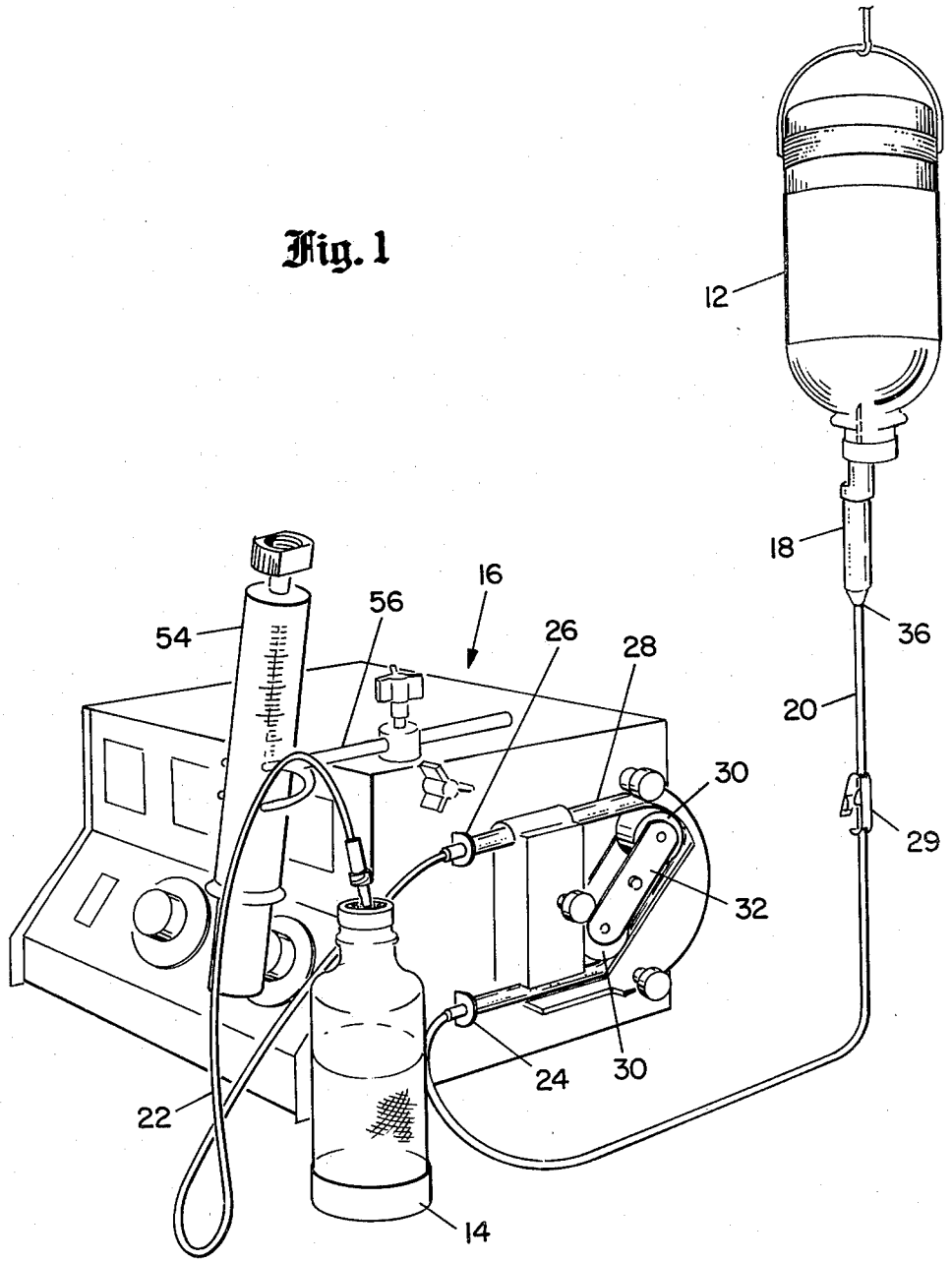
FIG. 1 illustrates the use of the fluid transfer unit in accordance with the invention.
Figure 2:
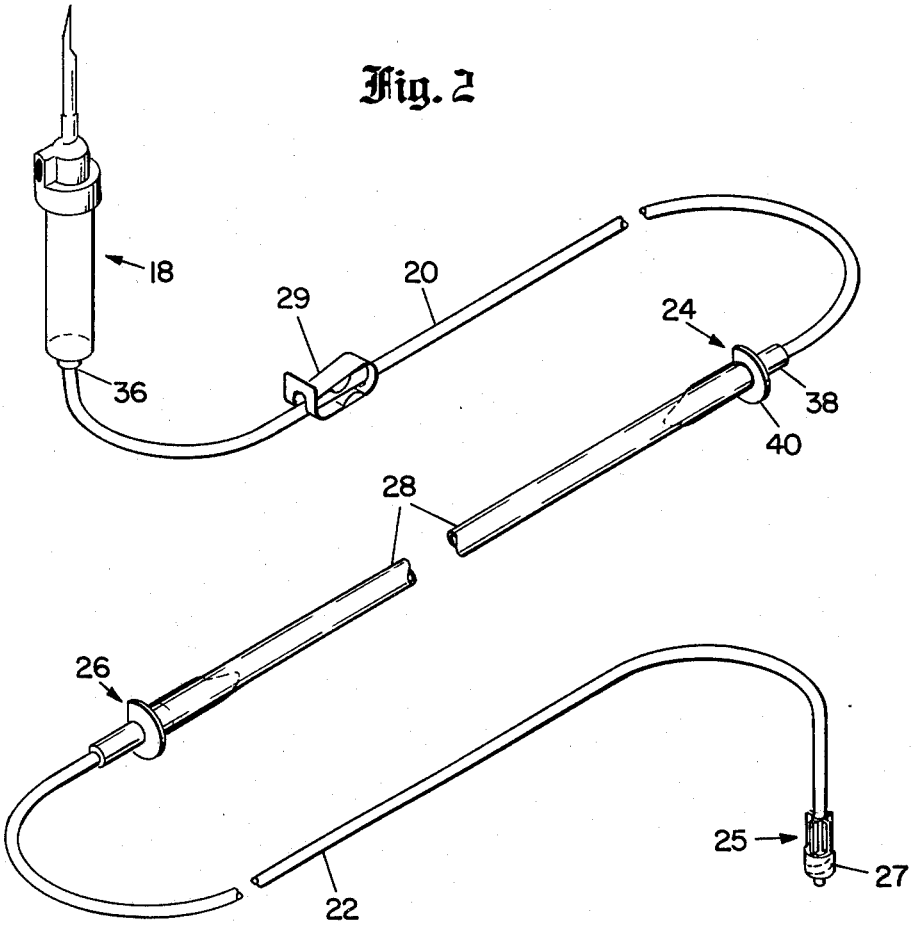
FIG. 2 is a more detailed showing of the transfer unit per se.
Figure 2:
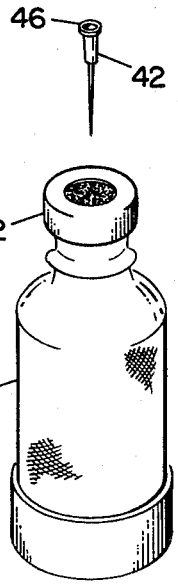

Referring more particularly to the drawings, it may be noted that some of the components shown in FIG. 1 are shown to an enlarged scale in FIG. 2, in which the same reference numerals are employed. Accordingly, by reference to both FIGS. 1 and 2, a clear understanding of the construction and the mode of operation of the invention is facilitated.

In FIG. 1, diluent from the large supply bottle 12 is being pumped into the smaller manufacturer's IVPB "Piggy Back" vial or bottle 14 by the peristaltic pump 16. In operation, a large vented spike 18 is inserted into the rubber seal through the cap of the inverted bottle 12, thus connecting the diluent to the thin (approximately $\frac{1}{8}$th inch outer diameter) plastic tube 20. Another plastic tube 22 serves to supply the pumped liquid to the smaller bottle 14 which is being filled. Two plastic fittings 24 and 26 interconnect the plastic tubes 20 and 22, respectively, with a relatively large diameter silicone rubber tube 28 which is acted upon by the rollers 30 secured to ends of the rotating arm 32 forming part of the peristaltic type pump. Incidentally, the pump per se is a known type of pump, and may for example, be manufactured by Wheaton Instruments, 1000 North Tenth St., Millville, NJ 08332. In practice, as the arm 32 rotates, the roller 30 squeezes the rubber tubing 16 and advances a metered amount of fluid through the tubing.

Now, referring in greater detail to FIG. 2, the spike 18 is vented in order to facilitate free flow of fluid through the relatively small, 1/8th inch outer diameter plastic tubing 20. The tubing 20 is cemented both to the lower end 36 of the spike 18 and also to the inside of the end 38 of the fitting 24. The fitting 24 is provided with a flange 40.

As mentioned hereinabove, the tubing 28 is oversized, having an outer diameter of 0.33 inch, and an inner diameter of 0.18 inch. This is in contrast to the normal commercially available one quarter inch outer diameter size tubing provided both for action by the peristaltic pump and also as the output conduit, in a sterile package including only the rubber tubing and associated end fittings.

Figure 3:
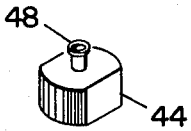
FIG. 3 shows an alternative adapter for use in filling a syringe.

The fitting 26 and the plastic tubing 22 are substantially identical with the fitting 24 and the tubing 20 as discussed hereinabove, and the fitting 26 is securely custom fitted both to the silicone tubing 28 and cemented to the plastic tube 22. A simple clamp type shut-off valve 29 is mounted on the inlet tube 20 and in use would be located close to connection 36. A Luer type fitting 25 is provided with the usual threads 27 for connection either to a vented needle 42 or to an alternative fitting 44 (see FIGS. 1 and 3) for use in filling syringes. In each case, the flanges 46 and 48 are provided with diametrically opposed areas which extend radially outward further than the remainder of the flange to engage the threads 26.

The manufacturer's IVPB "piggy back" bottle or vial 14 is provided with a closure 52 including a peripheral metal ring and an upper rubber surface through which the vented needle 42 may be inserted.

Incidentally, in FIG. 1 a syringe 54 is shown secured by a clamp 56 mounted on the housing of the pump 16. In the actual hookup shown in FIG. 1, however, the syringe is not being filled, but is merely being held in place, for later filling.

Concerning another aspect of the invention, the unit as shown in FIG. 2 is provided in a wrapped sterile package, and is only unwrapped when it is time to install it and initiate fluid transfer, as shown in FIG. 1.

Now, returning to a consideration of the advantages of the present invention as compared with prior "jury-rigged" arrangements, the principal advantages are the great savings in time and the easy avoidance of contamination. While it had previously been proposed to combine a small diameter elongated rubber tube provided by the pump manufacturer with a secondary transfer set, this involved the necessary use of a laminar flow hood for the sterile securing the two components together, and then the resulting combination still had several disadvantages. More specifically, first, the time for filling the 100 milliliter bottle was approximately 18 seconds, as compared with only 6 seconds for the unit of the present invention. Additionally, the risks of spilling the fluid being transferred and the dangers of contamination were greatly reduced by the present invention in a small diameter plastic tube valve is properly located near the outlet so that flow stops when prior shut-off occurs; and there is no danger of touch contamination or leakage contamination at the junctions between the various tubes.

Incidentally, in connection with the problem of relatively low rate of flow from the peristaltic pump using the $\frac{1}{4}$ inch outer diameter silicone rubber tube, other attempts to increase the rate of fluid flow have been tried but have proved unsuccessful. Thus, for example, when it was proposed to provide additional rollers on one type of peristaltic pump, using four rollers instead of the two with which it is normally equipped, the pump motor was overloaded and malfunctioned. Similarly, when higher pressure was attempted in other manners, leakage was found to occur in the hand secured output fastenings from the peristaltic pump. The solution of using oversized silicone rubber tubing and larger fittings cemented firmly to the smaller diameter plastic tubing and having tight overlapping custom fitted points with the silicone rubber tubing, has provided a practical and effective solution to the problem. As mentioned above, the time for filling a 100 milliliter bottle has been reduced from approximately 18 seconds to about 6 seconds using the sterile transfer unit of the present invention. With repetitive filling of large numbers of bottles, the cumulative savings of time on the part of hospital or other medical technicians, becomes substantial. Further, this savings of more than 50 percent in the time spent excludes the savings in time or involved in the assembling of the rubber tubing with the secondary transfer set under proper sterile conditions, in the makeshift transfer arrangements which were previously utilized. it is also noted that only about one foot of silicone rubber tubing is employed, just enough to be acted upon by the roller of the peristaltic pump, in contrast to the three feet of the smaller diameter silicone rubber tubing which was previously employed, both for the peristaltic pump active tube member and also as the output conduit. The savings which may be achieved using this transfer unit of the present invention and considering for the moment only the actual money cost of the units, would involve a reduction in price from in the order of $6.50 for the previous combination of rubber tubing and a secondary transfer set, by about 20% or 30%.

In closing, it is to be understood that the foregoing is a description of an illustrative embodiment of the invention. Departures from the specific fittings which are employed, and other mechanical details may be accomplished without departing from the spirit of the invention. Accordingly, the present invention is not limited to that precisely as shown and described hereinabove.

What is claimed is:

1. A high speed sterile transfer unit for sterile fluids, for use with peristaltic type pumps, comprising:

a large diameter flexible silicone rubber tube having an outer diameter in the order of one-third of an inch, and being approximately one foot long and of sufficient length to serve as the active flexible conduit of a roller-type peristaltic pump;

input and output small diameter plastic tubes each being in the order of one and one-half feet or more in length, and the diameter of said tubes being less than one-half that of said rubber tube;

first and second plastic fitting means cemented to the said input and output plastic tubes and having an interference fit with both of the opposite ends of said silicone rubber tube, each of said fittings having a substantial overlapping area with each of said tubes;

a large vented input spike cemented to the other end of said input plastic tube for receiving input fluid;

a threaded fitting cemented to other end of said output plastic tubing for attachment to a fluid dispensing fitting;

a shutoff clamp valve enclosing one of said plastic tubes;

said entire assembly as defined hereinabove being secured together as a single sterile unit; and peristaltic pump means for pumping fluid through said assembly at a rate of 50 cc's in less than ten seconds.

2. A high speed sterile transfer unit as defined in claim 1 wherein said plastic tubes have an outer diameter of approximately one-eighth inch, whereby the volume of fluid stored in said tubes is relatively small, and fluid will not flow out of the output plastic tube once fluid is shut off at the clamp valve or at the pump.

3. A high speed sterile transfer unit as defined in claim 1 wherein the inner diameter of said silicon rubber tube is in the order of 0.18 inch, whereby more fluid is pumped each time the roller passes over the tube than when conventional smaller diameter tubes are used.

4. A high speed sterile transfer unit as defined in claim 1 wherein said clamp valve is located on said input plastic tube, and wherein said two plastic tubes are of sufficiently small diameter that no sterile fluid will flow out of said unit once said clamp valve is closed.

5. A high speed sterile transfer unit for sterile fluids, for use with perstaltic type pumps comprising:

a large diameter flexible pumping tube having an outer diameter in the order of one-third of an inch, and having a length sufficient to serve as the active flexible conduit of a roller-type peristaltic pump, but with very little excess length;

input and output small diameter plastic tubes each being in the order of one and one-half feet or more in length, and the diameter of said tubes being less than one-half that of said pumping tube;

first and second plastic fitting means cemented to fit said input and output plastic tubes and custom fitted with an interference fit to opposite ends of said large diameter pumping tube, each of said fittings having a substantial overlapping area with each of said tubes;

an inlet fitting cemented to the other end of said input plastic tube for receiving input fluid;

an outlet fitting cemented to the other end of said output plastic tubing for attachment to a fluid dispensing fitting;

a shutoff clamp valve enclosing one of said plastic tubes;

said entire assembly as defined hereinabove being secured together as a single sterile unit; and peristaltic pump means for pumping fluid through said assembly at a rate of 50 cc's in less than ten seconds.

6. A high speed sterile transfer unit as defined in claim 5 wherein said plastic tubes have an outer diameter of approximately one-eighth inch, whereby the volume of fluid stored in said tubes is relatively small.

7. A high speed sterile transfer unit as defined in claim 5 wherein the inner diameter of said silicone rubber tube is in the order of 0.18 inch, whereby more fluid is pumped each time the roller passes over the tube than when conventional smaller diameter tubes are used.

8. A high speed sterile transfer unit as defined in claim 5 further comprising a vented output needle fitting secured to said outlet fitting.

9. A high speed sterile transfer unit as defined in claim 5 wherein said inlet fitting is a vented inlet spike means for receiving fluid from an inverted bottle of intravenous solution.

10. A method for the high speed transfer of fluid from a large container of sterile fluid to a small containers for sterile fluids comprising:

unwrapping a sterile fluid transfer unit, including a large diameter flexible pumping tube having an outer diameter in the order of one-third of an inch, and having a length sufficient to serve as the active flexible conduit of a roller-type peristaltic pump but with very little excess length; input and output small diameter plastic tubes each being in the order of one and one-half feet or more in length, and the diameter of said tubes being less than one-half that of said pumping tube; first and second plastic fitting means cemented to and securing said input and output plastic tubes to opposite ends of said large diameter pumping tube, each of said fittings having a substantial overlapping area with each of said tubes; an inlet fitting cemented to the other end of said input plastic tube for receiving input fluid, said inlet fitting being a vented spike; an outlet fitting cemented to the other end of said output plastic tubing for attachment to a fluid dispensing fitting; and a shutoff clamp valve enclosing one of said plastic tubes;

installing said flexible pumping tube into a peristaltic pump;

attaching a vented needle to said outlet fitting;

inserting said inlet vented spike through a sealing membrane on a large supply container of sterile fluid;

inserting said outlet vented needle through a sealing membrane covering the mouth of a first bottle constituting a small container for receiving the sterile fluid;

operating said peristaltic pump to transfer said sterile fluid to said container at a rate of 50 cc's of fluid in less than ten seconds;

removing said needle from first bottle and inserting it into the sealing membranes of successive additional bottles; and cycling said pump on and off to fill said additional bottles at said rate of 50 cc's of sterile fluid in less than ten seconds;

whereby the process of filling said bottles is expedited and simplified as compared with prior practices using constant small diameter transfer tubes.

11. A method as defined in claim 10 including the step of providing said sterile containers in the form of manufacturers piggyback bottles having rubber sealing membranes covering their mouths.

12. A system for the high speed sterile transfer of sterile fluids comprising:

a sterile assembly including:

(a) a large diameter flexible silicone rubber tube having an outer diameter in the order of one-third of an inch, and being approximately one foot long and of sufficient length to serve as the active flexible conduit of a roller-type peristaltic pump;

(b) input and output small diameter plastic tubes each being in the order of one and one-half feet or more in length, and the diameter of said tubes being less than one-half that of said rubber tube;

(c) first and second plastic fitting means cemented to the said input and output plastic tubes and having an interference fit with both of the opposite ends of said silicone rubber tube, each of said fittings having a substantial overlapping area with each of said tubes;

(d) a large vented input spike cemented to the other end of said input plastic tube for receiving input fluid;

(e) an output fitting cemented to the other end of said output plastic tubing for attachment to a fluid dispensing fitting;

(f) a shutoff clamp valve enclosing one of said plastic tubes;

(g) said assembly as defined hereinabove being packaged together as a single sterile unit;

a large container of sterile fluid, including membrane means for receiving said large vented spike;

a plurality of small bottles each having a sealing membrane covering its mouth;

a vented needle means, including means for securing it to said output fitting, for insertion through the sealing membranes of said small bottles; and peristaltic pump means for receiving said silicone rubber tube and for transferring said sterile fluid from said large container to said small bottles at a rate of 50 cc's of fluid in less than ten seconds;

whereby the filling of said bottles is greatly simplified and expedited as compared to prior practices using constant small diameter transfer tubes.

* * * * *